US006951311B1

(12) United States Patent
Moran

(10) Patent No.: US 6,951,311 B1
(45) Date of Patent: Oct. 4, 2005

(54) POOL CLEANING TOOL

(76) Inventor: James Moran, 1184 Lodge Cir., Spring Hill, FL (US) 34606

( * ) Notice: Subject to any disclaimer, the term of this patent is extended or adjusted under 35 U.S.C. 154(b) by 102 days.

(21) Appl. No.: 10/653,137

(22) Filed: Sep. 3, 2003

(51) Int. Cl.[7] ..... B05B 15/06
(52) U.S. Cl. ..... 239/532; 239/589; 134/167 R
(58) Field of Search ..... 239/280, 280.5, 239/281, 289, 532, 589, 597, 598; 134/167 R, 134/168 R

(56) References Cited

U.S. PATENT DOCUMENTS 1,557,477 A 10/1925 Klinkhammer
1,653,907 A * 12/1927 Hilgerink ..... 137/594
2,852,307 A 9/1958 Clark
4,750,883 A * 6/1988 Drake ..... 401/137
4,982,896 A * 1/1991 Crow ..... 239/11
5,005,598 A * 4/1991 Hodgdon ..... 134/138
5,133,503 A 7/1992 Giordano et al.
6,725,489 B1 * 4/2004 Zell ..... 15/1.7

* cited by examiner

*Primary Examiner*—David A. Scherbel
*Assistant Examiner*—Thach H. Bui

(57) ABSTRACT

A pool cleaning tool for producing one water jet directed toward an area to be cleaned and a second water jet directed away from the area to be cleaned includes a substantially rigid water conduit having an upper end and a lower end. The lower end has an opening therein defining an outlet and an inlet extends into the water conduit and is positioned generally adjacent to the upper end. A coupler is fluidly coupled to the inlet for releasably coupling a water supply hose to the water conduit. A tubular member is fluidly coupled to the lower end of the water conduit. The tubular member has a first aperture and a second aperture therein. The first and second apertures are positioned on generally opposite sides of the tubular member. Each of the first and second apertures is angled downward.

10 Claims, 2 Drawing Sheets

POOL CLEANING TOOL

BACKGROUND OF THE INVENTION

1. Field of the Invention

The present invention relates to pool cleaning devices and more particularly pertains to a new pool cleaning device for producing one water jet directed toward an area to be cleaned and a second water jet directed away from the area to be cleaned so that the force of the first water jet does not move the device away from the area to be cleaned.

2. Description of the Prior Art

The use of pool cleaning devices is known in the prior art. While these devices fulfill their respective, particular objectives and requirements, the need remains for a device that prevents the instability of a jet of water being ejected from a pool cleaning tool as it is moved along a pool surface.

SUMMARY OF THE INVENTION

The present invention meets the needs presented above by using a first jet of water which is to be directed at the area being cleaned and a second jet of water that is directed away from the area being cleaned so that the force of the second jet aids in countering the affect of the force of the first jet as it tends to push the tool away from area being cleaned.

Another object of the present invention is to provide a new pool cleaning device that includes an elongated handle for aiding a user of the device to reach all areas of the pool.

To this end, the present invention generally comprises a substantially rigid water conduit having an upper end and a lower end. The lower end has an opening therein defining an outlet and an inlet extends into the water conduit and is positioned generally adjacent to the upper end. A coupler is fluidly coupled to the inlet for releasably coupling a water supply hose to the water conduit. A tubular member is fluidly coupled to the lower end of the water conduit. The tubular member has a first aperture and a second aperture therein. The first and second apertures are positioned on generally opposite sides of the tubular member. Each of the first and second apertures is angled downward.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
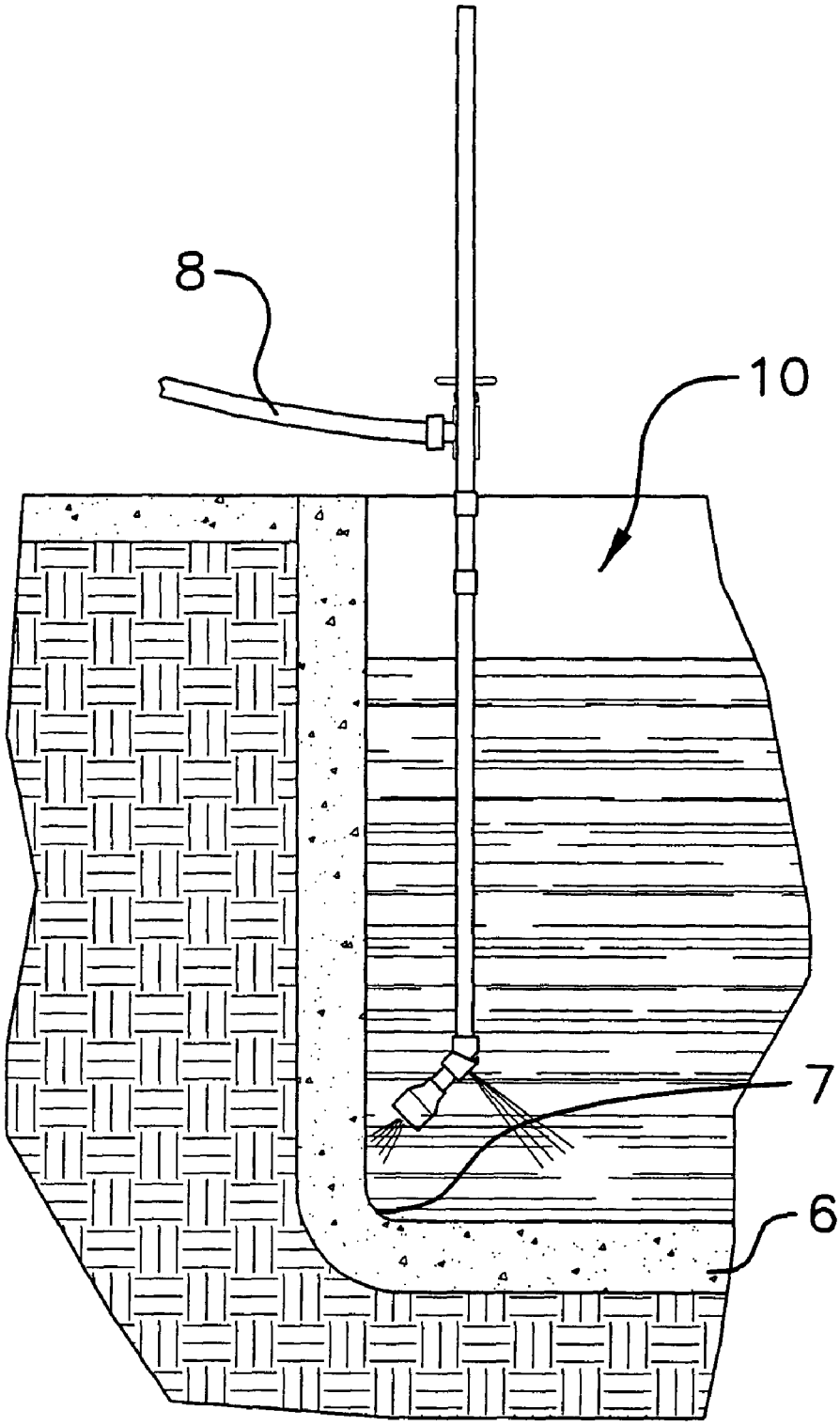
FIG. 1 is a schematic side view of a pool cleaning tool according to the present invention.
Figure 2:
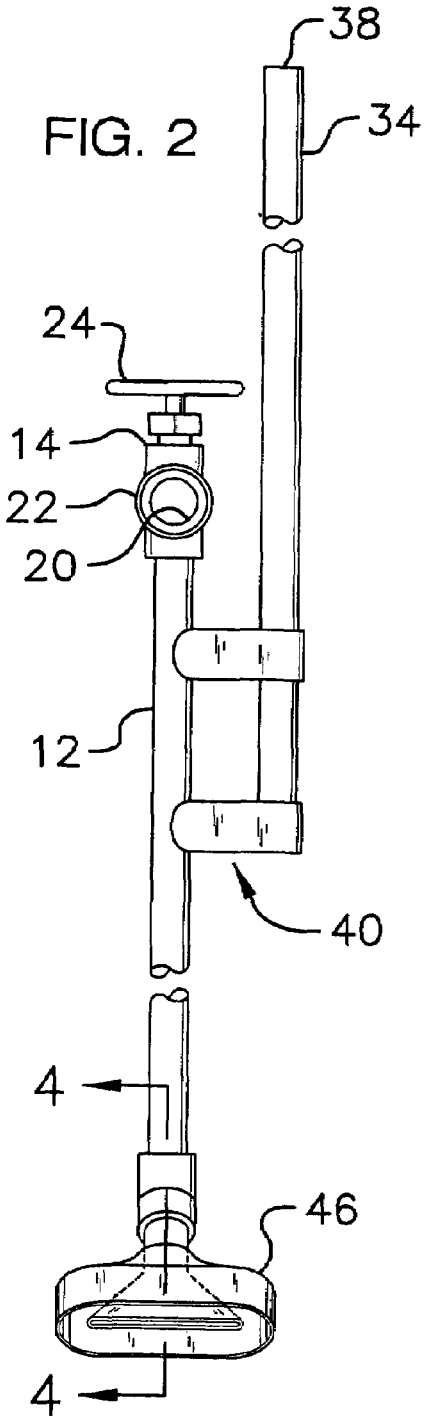
FIG. 2 is a schematic front view of the present invention.
Figure 3:
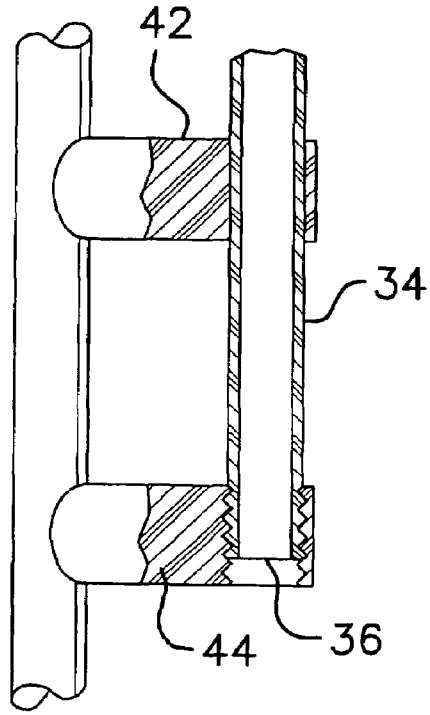
FIG. 3 is a schematic cross-sectional view of the handle and fastening member of the present invention.
Figure 4:
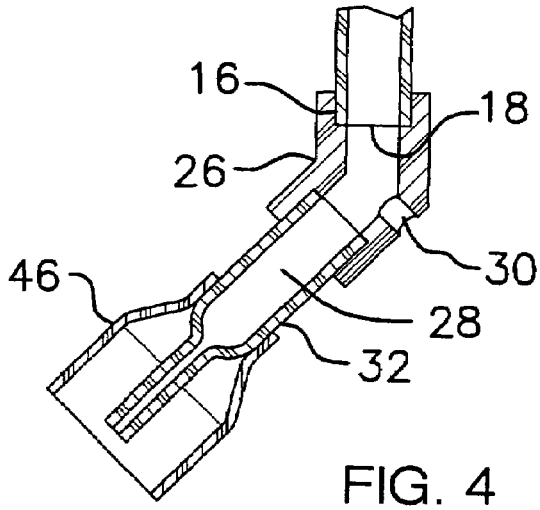
FIG. 4 is a schematic cross-sectional view taken along line 4—4 of FIG. 2 of the tubular member and nozzle of the present invention.

With reference now to the drawings, and in particular to FIGS. 1 through 4 thereof, a new pool cleaning device embodying the principles and concepts of the present invention and generally designated by the reference numeral 10 will be described.

As best illustrated in FIGS. 1 through 4, the pool cleaning tool 10 generally comprises a substantially rigid water conduit 12 having an upper end 14 and a lower end 16. The water conduit 12 preferably has a length between 3 feet and 6 feet. The lower end 16 has an opening 18 therein defining an outlet and an inlet 20 extends into the water conduit 12 and is positioned generally adjacent to the upper end 14. A coupler 22 is fluidly coupled to the inlet 20 for releasably coupling a water supply hose 8 to the water conduit 12. The coupler 22 is preferably a threaded female coupler. A valve 24 is fluidly coupled to the water conduit 12 for selectively opening or closing the inlet 20.

A tubular member 26 is fluidly coupled to the lower end 16 of the water conduit 12. The tubular member 26 has a first aperture 28 and a second aperture 30 therein. The first 28 and second 30 apertures are positioned on generally opposite sides of the tubular member 26. Each of the first 28 and second 30 apertures is angled downward such that an angle formed between a longitudinal axis of the water conduit 12 and each of the first 28 and second 30 apertures is generally between 10 degrees and 80 degrees and more preferably between 20 degrees and 70 degrees. A nozzle 32 is fluidly coupled to the first aperture 28 and extends away therefrom. Ideally, the nozzle 32 is selectively removable from the tubular member 26 and would include a plurality of structures depending on the needs of the person cleaning a pool 6. A protective housing 46 is optionally positionable around the nozzle 32 for protecting the nozzle and for protecting areas that the user does not wish to be struck with water that is ejected from the nozzle 32.

A handle 34 is attached to the water conduit 12. The handle 34 is elongated and has a first end 36 and a second end 38. The handle 34 preferably has a length between 3 feet and 6 feet. A fastening member 40 releasably secures the handle 34 to the water conduit 12 such that the first end 36 is generally adjacent to the upper end 14 of the water conduit 12 and the second end 38 of the handle 34 extends upwardly away from the water conduit 12. The fastening member 40 preferably includes a pair of brackets 42, 44 attached to the water conduit 12 at perpendicular angles with respect to the water conduit 12. The first end 36 of the handle 34 is extended through a first 42 of the brackets and threadably coupled to a second 44 of the brackets.

In use, the tool 10 is fluidly coupled to a water supply hose 8. As water flows through the tool 10, it is ejected outwardly through the first 28 and second 30 apertures. Water being ejected through the first aperture 28 is used to clean the surface lining 7 of a pool 6. The water being ejected outwardly through the second aperture 30 helps to stabilize the tool 10 so that the force of the water being ejected from the first aperture 28 does not move the tool 10 away from the area of lining 7 being cleaned.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool cleaning hose attachment for fluidly coupled to a hose, said attachment comprising:

a substantially rigid water conduit having an upper end and a lower end, said lower end having an opening therein defining an outlet, an inlet extending into said water conduit and being positioned generally adjacent to said upper end, a coupler being fluidly coupled to said inlet for releasably coupling the hose to the water conduit; and a tubular member being fluidly coupled to said lower end of said water conduit, said tubular member having a first aperture and a second aperture therein, said first and second apertures being positioned on generally opposite sides of said tubular member, each of said first and second apertures being angled downward.

2. The pool cleaning hose attachment of claim 1, further including a valve being fluidly coupled to said water conduit for selectively opening or closing said inlet.

3. The pool cleaning hose attachment of claim 1, wherein an angle formed between a longitudinal axis of said water conduit and each of said first and second apertures is generally between 10 degrees and 80 degrees.

4. The pool cleaning hose attachment of claim 3, further including a nozzle being fluidly coupled to said first aperture and extending away therefrom.

5. The pool cleaning hose attachment of claim 1, further including a nozzle being fluidly coupled to said first aperture and extending away therefrom.

6. The pool cleaning hose attachment of claim 1, further including a handle being attached to said water conduit.

7. The pool cleaning hose attachment of claim 6, wherein said handle is elongated and has a first end and a second end, a fastening member releasably securing said handle to said water conduit such that said first end is generally adjacent to said upper end of said water conduit and said second end of said handle extends upwardly away from said water conduit.

8. The pool cleaning hose attachment of claim 4, further including a handle being attached to said water conduit.

9. The pool cleaning hose attachment of claim 8, wherein said handle is elongated and has a first end and a second end, a fastening member releasably securing said handle to said water conduit such that said first end is generally adjacent to said upper end of said water conduit and said second end of said handle extends upwardly away from said water conduit.

10. A pool cleaning hose attachment for fluidly coupled to a hose, said attachment comprising:

a substantially rigid water conduit having an upper end and a lower end, said lower end having an opening therein defining an outlet, an inlet extending into said water conduit and being positioned generally adjacent to said upper end, a coupler being fluidly coupled to said inlet for releasably coupling the hose to the water conduit, a valve being fluidly coupled to said water conduit for selectively opening or closing said inlet;

a tubular member being fluidly coupled to said lower end of said water conduit, said tubular member having a first aperture and a second aperture therein, said first and second apertures being positioned on generally opposite sides of said tubular member, each of said first and second apertures being angled downward such that an angle formed between a longitudinal axis of said water conduit and each of said first and second apertures is generally between 10 degrees and 80 degrees;

a nozzle being fluidly coupled to said first aperture and extending away therefrom; and a handle being attached to said water conduit, said handle being elongated and having a first end and a second end, a fastening member releasably securing said handle to said water conduit such that said first end is generally adjacent to said upper end of said water conduit and said second end of said handle extends upwardly away from said water conduit.

* * * * *